US006106407A

United States Patent [19]

Peyton, Jr.

[11] Patent Number: 6,106,407

[45] Date of Patent: Aug. 22, 2000

[54] GOLF PRACTICE AND ANALYZER SYSTEM

[76] Inventor: Gilbert L. Peyton, Jr., 1960 N. Stonehurst Ave., #500, Rialto, Calif. 92377

[21] Appl. No.: 08/711,119

[22] Filed: Sep. 9, 1996

[51] Int. Cl.[7] ..... A63B 69/36

[52] U.S. Cl. ..... 473/225; 473/137

[58] Field of Search ..... 473/221, 222, 473/225, 233, 234, 386, 132, 133, 134, 135, 136, 137

[56] References Cited

U.S. PATENT DOCUMENTS

| | | | |
|---|---|---|---|
| 1,940,321 | 12/1933 | Pagett | 473/137 |
| 4,146,232 | 3/1979 | Stone | 473/137 |
| 4,181,309 | 1/1980 | Atkinson et al. | 473/136 |
| 4,451,043 | 5/1984 | Ogawa et al. | 473/225 |
| 4,477,079 | 10/1984 | White | 473/221 |
| 4,630,829 | 12/1986 | White | 473/221 |
| 5,108,105 | 4/1992 | Shimizu | 473/225 |
| 5,423,538 | 6/1995 | Stewart | 473/225 |
| 5,549,518 | 8/1996 | Wang | 473/137 |

*Primary Examiner*—William H. Grieb

[57] ABSTRACT

A golf ball practice and swing analyzer that incorporates a golf ball positioner that swings in a vertical plane and resides only momentarily adjacent the tee and then retracts upwardly, thus permitting the golfer to begin his or her swing the instant the ball positioner begins to move upwardly, combined with systems for determining and displaying the two most important, and largely determinative characteristics of the golfer's swing, the swing speed and swing time, in a very economical design criteria is disclosed.

8 Claims, 2 Drawing Sheets

GOLF PRACTICE AND ANALYZER SYSTEM

FIELD OF THE INVENTION

This is a machine and a method of operation for positioning a golf ball and analyzing particular aspects of the golfer's swing.

BACKGROUND OF THE INVENTION

There is elegance in simplicity and ingenuity in simplification; indeed, some of the most ingenious advances are the replacement of complex, trouble-prone, expensive and cumbersome devices or ideas with simple, straight forward and effective devices or concepts.

This is a crowded art.

The prior art is replete with machines for positioning golf balls to permit the golfer to practice his or her swing. One such device, for example, deposits a ball in a cup, the cup swings horizontally on a pivot around to a give position and the cup is caused to release the ball at a given point, on a tee for example. The golfer must wait for the cup to swing essentially back to its retracted position before beginning his or her swing.

The prior art is also replete with systems, installations and machines that detect some or many aspects of the golfer's swings. Several video camera systems position one or more cameras to record a swing, or a portion of the swing, of the golfer coupled with various other equipment are disclosed in the prior art. Many systems that require that the golf club be provided with a reflective strip or spot, with a magnet, or with some other detectable device, or which require the use of special clubs, are disclosed in the prior art.

Systems are disclosed that detect the position of the golfer's feet, back, arms, etc., or which require that the golfer assume a particular stance or position add a further dimension in this crowded art, often with little or no advantage.

Exemplary of the prior art are devices disclosed by White in U.S. Pat. Nos. 4,630,829 and 4,477,079.

Golf swing analyzers that track the entire swing, or a large portion of the swing, in one or more dimensions, are disclosed in the prior art.

It is an object of this invention to provide a machine, and method of operation, that combines three important features. The machine of this invention is simple and inexpensive, as compared with most devices of the prior art. The machine positions the golf ball and lets the golfer position the golf club for the swing, and even practice the swing, during the positioning of the ball and permits the golfer to complete the swing while the positioner is being retracted. The analyzer provides accurate data display, and printout if desired, of the two most important characteristics of an effective golf swing.

SUMMARY OF THE INVENTION

The present invention is an electrically operated machine that comprises, as a combinational system, a golf ball positioner that receives a golf ball in a cup mounted on the distal end of a shaft in an initial position and pivot means supporting the proximal end of the shaft for causing the cup to move in a vertical plane from a vertical position to a horizontal position for guiding the ball to a golf tee and retracting the cup in said vertical plane to the initial position. The invention comprises first and second light beam and beam detector sets positioned one on each side of the tee position and means for processing signals derived from said beam source—beam detector sets to derive the speed at which the club is traveling at the end of the swing and the time required to perform the swing. Speed and swing time data are displayed for the golfer to note, and may be printed out for subsequent comparison. It is now being recognized that consistent golfing is in large measure a function of a consistent time for completing the swing. Thus, the golfer can practice his or her swing to develop a technique for consistently hitting the golf ball with a club moving at a predetermined speed.

More specifically, the present invention is a golf practice and golf swing analyzing machine. The machine comprises, in combination, a pad constructed and configured to lie horizontally on the ground or floor of a golf practice facility and a console extending upwardly from the pad. A golf ball positioner is mounted in the console. The golf ball positioner is configured and constructed to position a golf ball at a predetermined location on the pad for being hit by the user. The golf ball positioner comprises, in combination, a generally cylindrical cup for receiving and holding a golf ball that is constructed and configured to permit the golf ball to roll from the cup under only the influence of gravity and/or inertia but only when the cylindrical cup is substantially horizontal and substantially parallel to the pad. The golf ball positioner also comprises, as part of the combination, pivot means for moving the cylindrical cup in a vertical plane from an initial position in which the cylindrical cup is vertically disposed for receiving a golf ball to a substantially horizontal plane for depositing the golf ball on the pad and back to the initial position. The combination of the invention also includes means for sensing the speed of the user's golf club when the club strikes the ball and displaying said speed. The swing speed sensing means comprises a first light beam source and photo detector combination that is positioned on a first side of said predetermined location and a second light beam source and photo detector combination that is positioned on the other side of said predetermined location. The first and second combinations are configured, located and constructed such that when the user swings a golf club the club passes through a first light beam focussed by the first light beam source and detected by the first photo detector. The club, during said swing, then hits the ball. After hitting the ball, the club then passes through a second light beam focussed by the second light beam source and detected by the second photo detector. The swing speed sensing means also includes means for measuring a first time interval between the passage of the club through said light beams and calculating from said first time interval the speed of travel of the golf club. Means are provided for displaying to the user the golf club speed during the first interval. The invention also comprises, as part of the combination, means for sensing and displaying the time interval occupied by the user's swing. The swing time sensing and display means comprises means for measuring a second time interval between two sequential passages of the club through said first light beam without passage through the second light beam; and means for displaying to the user the golf club swing time during the second time interval.

DESCRIPTION OF THE PREFERRED EMBODIMENT

The present invention is made up of a unique arrangement and interconnection of, in large part, commercially manufactured and readily available components, and some components that are unique to the invention. The unique components are described in some detail and those skilled in the art will have no difficulty in obtaining the commercially available components. Thus, the following description will be amply sufficient to enable anyone skilled in the art to make and use the invention. It will be understood that it is the combination of components and systems as defined in the claims that is the invention, and that, in general, any of many commercially available or custom made components may be used or substituted one for another with little or no change in the overall system.

Figure 1:
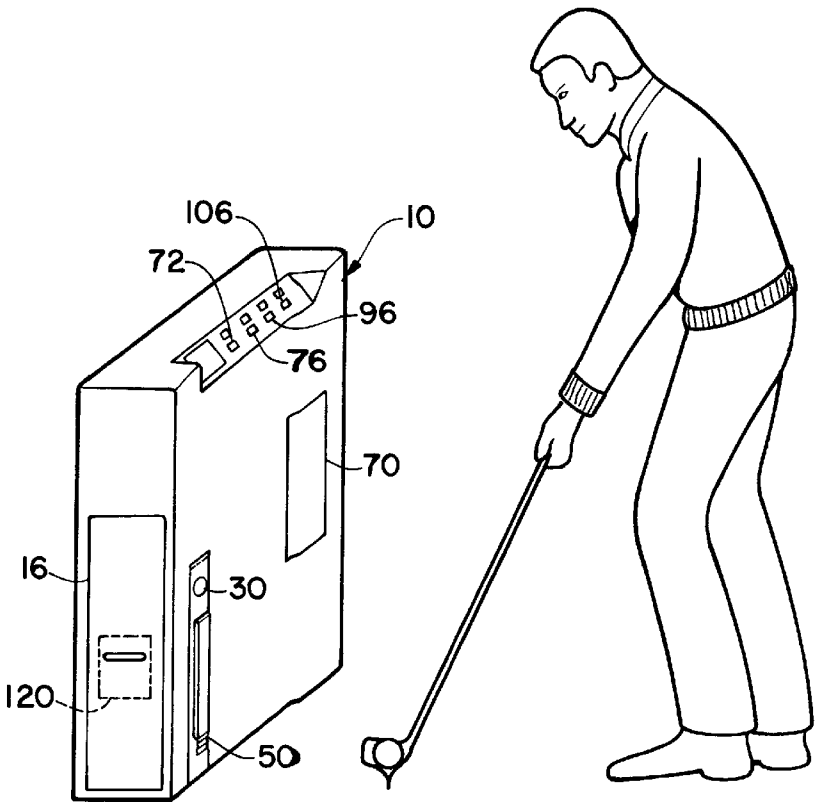
FIG. 1 is a generalized depiction of the machine of this invention in use by a golfer.

Reference is made, first, to FIG. 1 for a description of the overall function of the invention and its use by the golfer, the golfer being depicted pictorially generally in the position in which he will use the invention. The practice pad and light beam sources are omitted in FIG. 1 for clarity in illustration.

The machine 10 comprises a weather resistant console for packaging most of the electronic components and the mechanical components. As depicted, the console is about 24 to 40 inches in height, 18 to 30 inches in width, and 6 to 12 inches in depth, the exact size being a matter of convenience rather than function. The console is conveniently provided with an end plate on each end of thereof, end plate 16 in which a printer 120 is mounted being shown in FIG. 1. The console may have mounted therein a coin or token console 70, if the invention is to be used in a commercial establishment. A golf ball positioning mechanism comprising a cup 30 and supporting pivot mechanism 50 are provided for placing a golf ball on a tee, or on an artificial turf pad, for being hit by the golfer. A ball release button 72 and data display devices 76, 96 and 106, all to be described in full, are positioned to be conveniently reached and viewed by the golfer when he or she is using the invention.

Referring now to FIGS. 2, 3, 4 and 5, the structure and operation of the invention will be described.

The invention may optionally include a conventional photocell panel and associated circuitry 12 for converting light and/or heat to electricity and conducting the electricity so generated to the invention. The invention may also, optionally, include an electric storage battery and associated circuitry 14 for storing and serving up electric energy to the machine. While an electric power source is required, it may simply be means for connecting the machine to a power line, or it may be a photocell 12 or a battery 14, or alternative sources, or any combination thereof. In the example depicted, the photocell 12 and battery 14 are connected to a master control circuit board 20 for sending power to or receiving power from the circuit board 20 or connected components, as may be required, all of which is conventional electronic circuitry.

As mentioned earlier, it is convenient to provide end panels 16 and 18 on the respective ends of the console packaging the components. It will be noted again that panel 16 may optionally have mounted thereon a printer 120.

The console is so constructed and configured as to define a golf ball receptacle into which the golfer can drop a number of golf balls. The golf balls are conveyed by gravity down an inclined chute 24 and dropped into a vertical chute 26. The downward movement of the golf ball is halted by the projecting end of a solenoid 80 which, with its associated circuitry, permits one ball at a time to drop further down the vertical chute 26. The ball is dropped into chute 26 and is stopped by the projecting end of solenoid 82 which, as will be described, lets the ball, or balls, drop further down the vertical chute 26 and then into the top of a golf ball positioner cup 30 of unique design.

Figure 4:
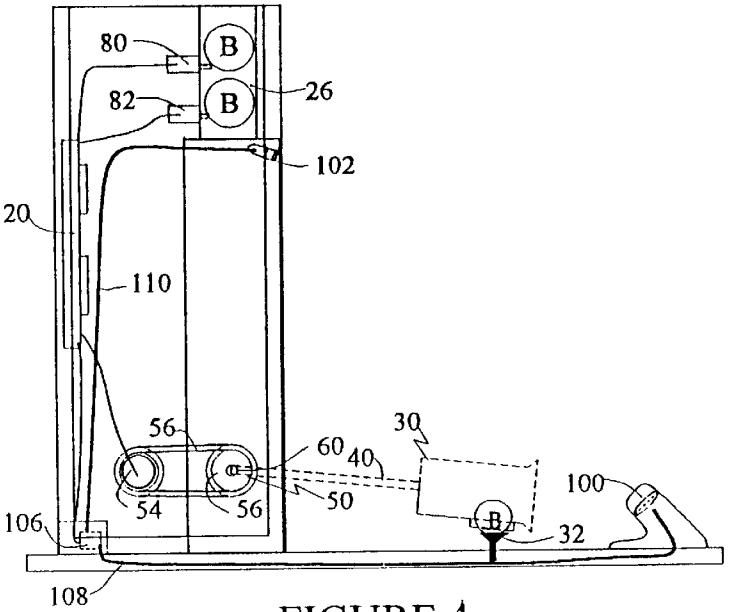
FIG. 4 is a side elevational view of the lower portion the machine with the side panel removed, depicting the golf ball receiving cup in the horizontal position wherein the ball is gravitationally deposited on the tee.
Figure 3:
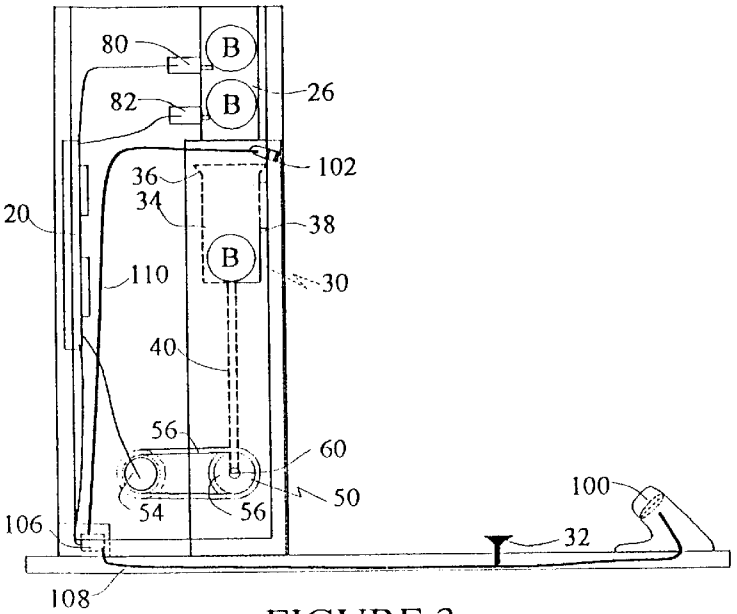
FIG. 3 is a side elevational view of the lower portion the machine with the side panel removed, depicting the golf ball receiving cup in the initial retracted position.

The golf ball positioner cup 30, more fully depicted in FIGS. 3 and 4, is so constructed and configured as to permit the ball to move by gravity and/or inertia from the downward movement of the cup on to a tee 32, or simply onto a pad of artificial turf, as desired by the user. The cup 30 comprises a generally cylindrical sleeve 34 that defines a distal end 36 which may optionally be flared outwardly to better receive golf balls as the balls are dropped from the vertical chute 26, and defines a side passage large enough for a golf ball to pass therethrough to which may optionally be attached a short cylindrical guide 38 whose axis is perpendicular to the inherent axis of the cylindrical sleeve 34 for positioning the golf ball in a predetermined position.

Figure 2:
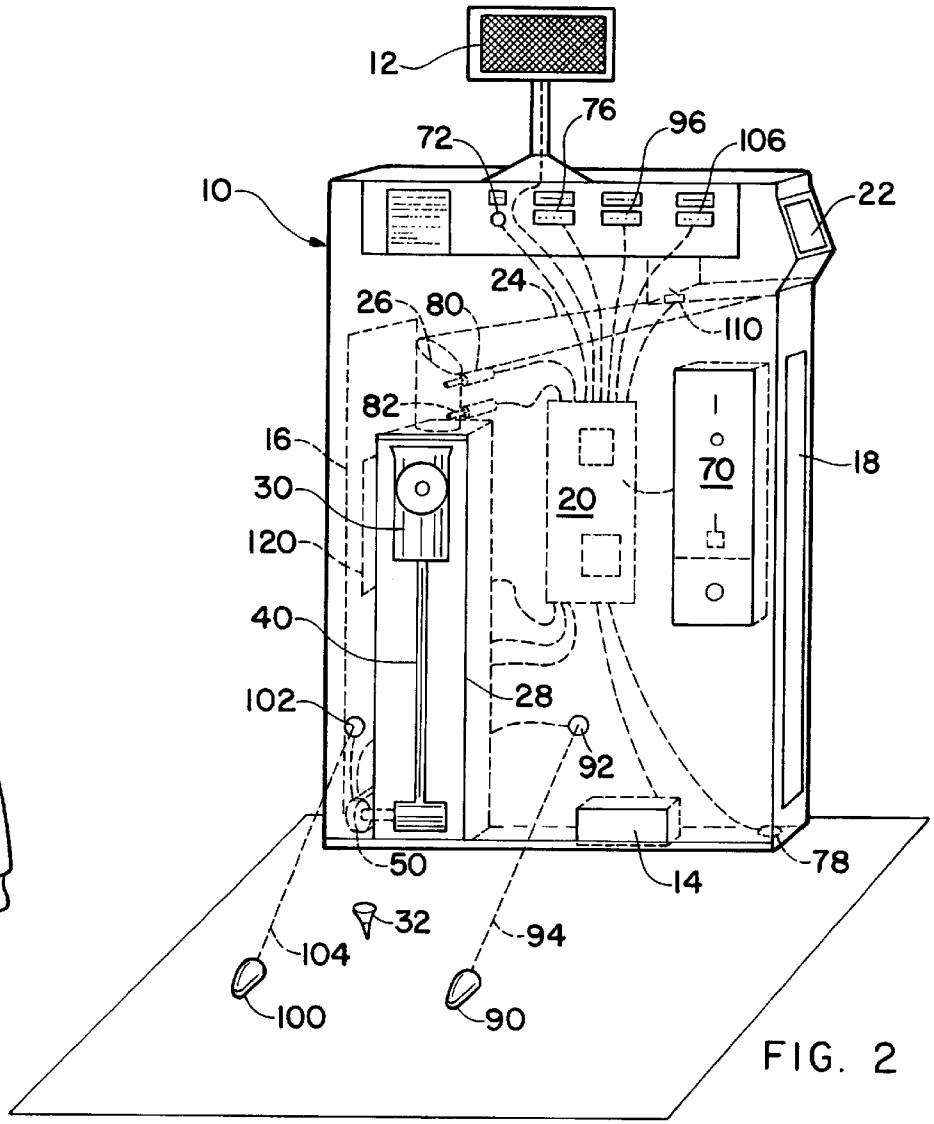
FIG. 2 is a perspective view showing the major functional structures and systems of the invention, with the golf ball receiving cup in the initial retracted position, and depicting an optional photocell panel for providing electric energy from the sun and an optional battery, both or either as power sources.

The golf ball positioner cup 30 is supported on the distal end of a shaft 40 which, in turn, is supported by and moved by a pivot mechanism generally indicated at 50. The pivot mechanism 50 may be of any construction that causes the shaft 40, and hence the cup 30, to move in a vertical plane from a vertical initial retracted position, as depicted in FIGS. 2 and 3, where the cup 30 is positioned to receive golf balls from the chute 26, downwardly to a position wherein the shaft and cup are substantially horizontal or slightly below horizontal to permit a golf ball in the cup to fall by force of gravity and/or inertia from the pivoting movement through the passage and guide 38 onto a tee or the turf, as depicted in FIG. 4.

Focussing again upon the construction of the cup 30 and making particular reference to FIGS. 3 and 4, it will be noted that the cylinder 34 is long enough and the guide 38 is position sufficiently close to the distal end of the cylinder 34 to permit a golf ball to reside in the cup below the passage and guide 38. Thus, the ball will remain in the cup until the cup is positioned substantially horizontally at which time the ball will roll under the influence of gravity or inertia gained from the downward movement of the cup to the passage and drop through the guide.

A convenient pivot mechanism 50 comprises a reversing electric motor 52 that drives a pulley 54 which, in turn, drives a belt 56 and, through the belt, drives a pulley 58 and shaft mount 60. The mechanism 50 is so constructed as to pivotally rotate the shaft mount 60 approximately 90 degrees thereby moving the cup from the vertical initial position to the horizontal position, all as described above, and back to the vertical initial position. There are, of course, any number of mechanisms capable of performing the necessary movement. In the depicted example, the vertical and horizontal positions may be sensed by limit switches, photo or magnetic sensors, etc., to stop the movement at the proper time and cup position. A simple reversing motor that moves only 90 degrees and reverses to move back to the start position may be used. So long as the substantially 90 degree movement described is effected, it matters little what mechanism is used.

In commercial golfing establishments, it is convenient to provide the console with a coin box and associated circuitry 70 for receiving coins or tokens, as the management prefers, for activating the machine. If the machine is used by only one individual or provided without charge, the coin box may, of course, be omitted.

A "BALL RELEASE" button 72 is provided, conveniently mounted in an inclined portion of the console. A "TIME REMAINING" display 76, indicating to the user how much time for his or her use remains, is conveniently provided. Two important displays are provided. A "SWING SPEED" display 96 and a "SWING TIME" display 106 provide the golfer with instant information as to his or her last golf stroke. A printer 120 may be mounted in the console, on the left hand access panel 16 in the exemplary embodiment, for printing out the swing speed and swing time of the strokes as they are taken, and/or a summary of previous events.

Figure 5:
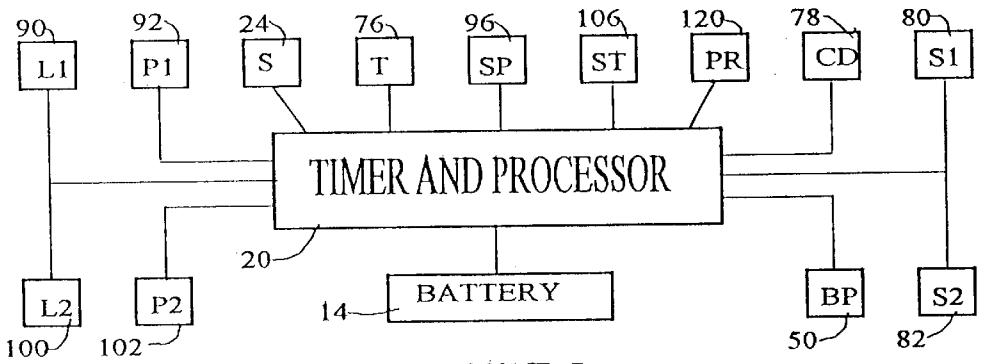
FIG. 5 is a block functional schematic diagram of the machine of this invention.

With continuing reference to all of the Figures and with particular reference to FIG. 5, the operation of the invention will be described.

To activate the machine, the user inserts a token or coin in the coin box 70. The coin box and associated circuitry 70 turn the machine on, and, in response thereto, the master control circuit board 20 readies the machine for use. The master control circuit board 20 may be of any of a virtually infinite number of particular configurations. From the functions as described herein, a skilled technician or engineer can easily configure a commercial digital microprocessor board or design a custom microprocessor circuit board to perform the desired functions. The master control circuit board 20 and associated circuitry comprises, basically, a timer and ON/OFF switches responsive to signals, described herein, that sense the position of the various devices of the machine, etc. In the embodiment currently being manufactured, the circuit board is microprocessor which uses a commercially available microprocessor chip. The microprocessor is not, per se, critical, however, and a great variety of circuitry and microprocessor devices may be used.

If the invention is activated by a coin box, the master control 20 generates a timing signal that actuates the TIME REMAINING display 76 to cause it to display the number of minutes remaining and to change the display as the time is used up. If no coin box is provided, the TIME REMAINING display may be omitted.

The user drops the desired number of golf balls in the receptacle 22. Some of the balls roll down the inclined chute 24 and one or more balls drop down the vertical chute 26 where the first ball is stopped by the solenoid 80. A rotating paddle 110 may optionally be provided in the receptacle area for feeding the golf balls to the chute 24.

The master control 20 first sends a signal to the solenoid 80 causing the solenoid to momentarily withdraw the projecting end thereof allowing one golf ball to drop past the projection thereof. The golf ball is stopped by the projection of solenoid 82. The master control 20 sends a signal to the solenoid 82 to cause the same to momentarily withdraw the projection permitting the golf ball to drop into a recess 28 formed in the console and into cup 30.

The invention comprises a club sensor 78 which, conveniently, is positioned at the right end of the console. To actuate the machine, and cause a golf ball to be positioned to be hit, the golfer simply positions the distal end of his or her golf club in the vicinity of the club sensor 78. The sensor may be a photo sensing device that senses an interruption in incident light, an inductive resonant device the senses the presence of some material other than air in the vicinity thereof, such as are commonly used in elevators, or any other device that will generate a signal when a club is position adjacent the device. The club sensor 78 actuates the master control 20 to send a signal to the pivot mechanism 50 to actuate the same to pivot the ball positioning cup 30 from the vertical initial retracted position, shown in FIG. 3, to the horizontal position, shown in FIG. 4, at which position the cup remains momentarily to permit the golf ball to fall by gravity or inertia through the guide 38 on to the tee 32 or the turf, as the user desires. After a momentary pause, the pivot mechanism 50 retracts the cup 30 to the initial vertical position, and the master control 20 causes the solenoids 80 and 82 to drop another ball into the cup 30, as previously described. The user causes the mechanisms and systems described to repeat the cycle by temporarily positioning the golf club adjacent the golf club sensor.

With particular reference to FIG. 1, the SWING SPEED and SWING TIME systems of the invention will now be described. The SWING SPEED system comprises a light beam window 90 and a paired light beam windows 92, and a second light beam window pair 100 and 102. A very reliable system comprises a light sensor 106 and a pair of optical fibers, one such pair comprising fiber optic lines 108 and 110, depicted in FIGS. 3 and 4. A like optical fiber is provided from the light sensor 106 to the light beam window 90. Additional light from a conventional incandescent light, an LED, or any other light-producing device may be included in the light sensor. The light beam windows 100 and 102 with the fiber optics define a beam of light between the respective paired windows and a light circuit that originates and ends at the light sensor 106. These sets of paired light beam window systems and associated circuitry detect an interruption in the light circuit defined by the pairs of fiber optics and from that interruption generates and sends a signal to the master control 20 when the golf club passes through the light beam. The master control 20 timer measures the time between the passage of the club through the beam 94, between the pair 90–92, and the passage of the club through the beam 104, between pair 100–102 and converts the time signal into golf club swing speed data that are displayed in the SWING SPEED display 96. The golf club swing speed is, of course, the initial speed of the golf ball which the user can then correlate with the distance and flight path of the ball, depending, of course, on the club and ball used, the terrain, etc.

The golfer first positions the club adjacent and right of the ball, as depicted in FIG. 1, before starting his or her swing. As the club cuts the light beam 94 between the pair 90–92, at the beginning of the back swing, a timer in the master control starts running and the time for the golfer to complete the swing and move the club again through the light beam 94 on the forward swing is determined. When the golfer completes the swing and breaks the light beam 104 between the pair 100–102, the processor circuitry use the time between the last two times the light beam 94 between pair 90–92 was broken and convert that data to display the swing time in the SWING TIME display. As mentioned, the swing time is now recognized as a very important factor in determining the flight of the golf ball. Consistent swing time largely determines consistent ball flight characteristics.

If provided, the printer 120 and associated circuitry prints the SWING SPEED and SWING TIME data generated by the master control 20. Of course, the SWING SPEED and SWING TIME may be called and labeled with other indicia as the user may desired.

If at the end of a practice session there are golf balls remaining in the console, the user may press the BALL RELEASE button which with associated circuitry signals the master control to actuate both solenoids 80 and 82 to hold the projections in the withdrawn position for a period of time, several seconds to a minute or more, sufficient to permit all of the balls in the console receptacle 22 to roll down the chute 24, drop through chute 26 and simply roll out of the cup 30. After the predetermined period of time, the master control 20 actuates the pivot mechanism to deposit the last ball on the pad as previously described.

A review of the foregoing in connection with the drawings will make it apparent that the present invention achieves the object stated above. Note that the ball positioner system 30–50 resides only momentarily adjacent the tee and then retracts upwardly. Thus, the golfer may begin his or her swing the instant the ball positioner begins to move upwardly and complete the swing. This possible only because of the vertical plane movement of the ball positioner, removing the ball positioner almost instantly from the swing path of the club. It is not possible to begin the swing using traditional horizontally moving ball positioners until the ball positioner is fully or substantially fully retracted. In combination with the proceeding, the two most important, and largely determinative characteristics of the golfer's swing, the swing speed and swing time are measure and displayed to permit the golfer to perfect his or her swing. Importantly, these features are combined in a simple system made up in large part of commercially available components, many of which are may be selected from any of several sources, providing very economical design criteria.

INDUSTRIAL APPLICATION

This invention us useful in the golf equipment manufacturing industry.

What is claimed is:

1. A golf practice and golf swing analyzing machine comprising, in combination:

a pad constructed and configured to lie horizontally on the ground or floor of a golf practice facility;

a console extending upwardly from the pad;

a golf ball positioner mounted in the console, the golf ball positioner being so configured and constructed as to position a golf ball at a predetermined location on the pad for being hit by the user and comprising, in combination:

a generally cylindrical cup for receiving and holding a golf ball, the cup being so constructed and configured as to permit the golf ball to roll from the cup under only the influence of gravity and/or inertia only when the cylindrical cup is substantially horizontal and substantially parallel to the pad; and pivot means for moving the cylindrical cup in a vertical plane from an initial position in which the cylindrical cup is vertically disposed for receiving a golf ball to a substantially horizontal plane for depositing the golf ball on the pad and back to the initial position;

swing speed sensing and display means on the pad for sensing the speed of the user's golf club when the club strikes the ball and displaying said speed, said swing speed sensing means comprising a first light beam source and photo detector combination positioned on a first side of said predetermined location and a second light beam source and photo detector combination positioned on the other side of said predetermined location, said first and second combinations being so configured, positioned and constructed that when the user swings a golf club the club first passes through a light beam focussed by the first light beam source and detected by the first photo detector, then hits the ball, and then passes through a second light beam focussed by the second light beam source and detected by the second photo detector;

means for measuring a first time interval between the passage of the club through said light beams and calculating from said interval the speed of travel of the golf club, and means for displaying to the user the golf club speed during the first interval; and swing time sensing and display means for sensing and displaying the time interval occupied by the user's swing, said swing time sensing and display means comprising:

means for measuring a second time interval between two sequential passages of the club through said first light beam without passage through the second light beam; and means for displaying to the user the golf club swing time during the second time interval.

2. The invention of claim 1 wherein the pivot means comprises a reversing electric motor, a pivot support driven by the electric motor and an elongate shaft on the pivot support that supports the cylindrical cup at a distance from the pivot support.

3. The invention of claim 2 wherein the first and second light beam sources, respectively, comprise means mounted on the pad for focussing light, means in the console for producing light, and fiber optic means for transmitting light to the respective means mounted on the pad for focussing light.

4. The invention of claim 3 wherein the cup comprises a generally cylindrical sleeve 34 inherently having a first concentric axis and which is so constructed and configured as to define a distal end 36 that flare outwardly from said first axis for receiving a golf ball and a side passage large enough for a golf ball to pass therethrough, a cylindrical guide 38 inherently having a second concentric axis whose axis is perpendicular to said first, said guide being so constructed and configured as to guide a golf ball from the cup to a predetermined position on the pad.

5. The invention of claim 1 wherein the first and second light beam sources, respectively, comprise means mounted on the pad for focussing light, means in the console for producing light, and fiber optic means for transmitting light to the respective means mounted on the pad for focussing light.

6. The invention of claim 5 wherein the cup comprises a generally cylindrical sleeve 34 inherently having a first concentric axis and which is so constructed and configured as to define a distal end 36 that flare outwardly from said first axis for receiving a golf ball and a side passage large enough for a golf ball to pass therethrough, a cylindrical guide 38 inherently having a second concentric axis whose axis is perpendicular to said first, said guide being so constructed and configured as to guide a golf ball from the cup to a predetermined position on the pad.

7. The invention of claim 1 wherein the cup comprises a generally cylindrical sleeve inherently having a first concentric axis and which is so constructed and configured as to define a distal end that flares outwardly from said first axis for receiving a golf ball and a side passage large enough for a golf ball to pass therethrough, a cylindrical guide inherently having a second concentric axis whose axis is perpendicular to said first, said guide being so constructed and configured as to guide a golf ball from the cup to a predetermined position on the pad.

8. In a golf practice and swing analyzing machine that positions golf balls for being hit by a user and displays indicia characteristic of the user's golf swing, the improvement wherein the golf ball positioner comprises a generally cylindrical sleeve inherently having a first concentric axis and which is so constructed and configured as to define a distal end that flares outwardly from said first axis for receiving a golf ball and a side passage large enough for a golf ball to pass there through, a cylindrical guide inherently having a second concentric axis whose axis is perpendicular to said first, said guide being so constructed and configured as to guide a golf ball from the cylindrical sleeve to a predetermined position, and pivot means for moving the cylindrical sleeve in a vertical plane from an initial position in which the cylindrical sleeve is vertically disposed for receiving a golf ball to a substantially horizontal plane for depositing the golf ball on the pad and back to the initial position.

* * * * *